United States Patent [19]

Inouye et al.

[11] 4,032,345

[45] June 28, 1977

[54] SILVER HALIDE MATERIALS CONTAINING PHOTOGRAPHIC COLOR COUPLERS WITH ISOTHIOCYANATO GROUPS

[75] Inventors: Kozo Inouye; Yukio Yokota; Akio Okumura; Seiiti Kubodera; Keisuke Shiba, all of Minami-ashigara, Japan

[73] Assignee: Fuji Photo Film Co., Ltd., Minami-ashigara, Japan

[22] Filed: Aug. 1, 1975

[21] Appl. No.: 601,567

[30] Foreign Application Priority Data

Aug. 2, 1974 Japan ..... 49-88677

[52] U.S. Cl. ..... 96/55; 96/56.5; 96/100; 260/310 A

[51] Int. Cl.[2] ..... G03C 7/00; G03C 1/40

[58] Field of Search ..... 96/100, 55, 56.5; 260/310 A

[56] References Cited

UNITED STATES PATENTS 3,212,894 10/1965 Menzel et al. ..... 96/56.6

3,253,924 5/1966 Loria et al. ..... 96/100

3,576,636 4/1971 Matsui et al. ..... 96/100

OTHER PUBLICATIONS

Ishda et al., Chemical Abstracts, vol. 69, 106256c, (1968).

*Primary Examiner*—J. Travis Brown

*Attorney, Agent, or Firm*—Sughrue, Rothwell, Mion, Zinn & Macpeak

[57] ABSTRACT

A photographic 2-equivalent color coupler capable of coupling with the oxidation product of an aromatic primary amine developing agent in which the coupling position is substituted with an isothiocyanato group; a color photographic emulsion, material, and developer containing the above-described 2-equivalent color coupler; and a method of forming color images comprising developing an exposed silver halide photographic material in the presence of the above-described 2-equivalent color coupler.

12 Claims, No Drawings

SILVER HALIDE MATERIALS CONTAINING PHOTOGRAPHIC COLOR COUPLERS WITH ISOTHIOCYANATO GROUPS

BACKGROUND OF THE INVENTION

1. Field of the Invention

The present invention relates to color couplers for photography and particularly to novel 2-equivalent color couplers and color photographic sensitive materials containing such color couplers.

2. Description of the Prior Art

It is well known that oxidized aromatic primary amine developing agents react with dye forming couplers to form color images by color development after exposure of silver halide photographic sensitive materials to light. In this case, a color reproduction process according to a conventional subtractive process is utilized to form cyan, magenta and yellow color images which are in a complementary relation with red, green and blue colors. For example, phenol derivatives or naphthol derivatives are used as couplers for forming a cyan color image and 5-pyrazolone derivatives, pyrazolobenzimidazole derivatives or imidazolone derivatives are used for forming a magenta color images.

In color photographic processes, the color forming couplers which are added to a developer or incorporated in photosensitive photographic emulsion layers or other color forming layers react with an oxidation product of the color developing agent formed by development to form nondiffusible color images. Almost all conventional cyan dye forming couplers and magenta color forming couplers are 4-equivalent couplers, that is, theoretically, 4-equivalent couplers stoichiometrically require 4 moles of exposed silver halide as an oxidizing agent for formation of 1 mol of the dye. Incorporation of a large amount of silver halide in the photosensitive layer is disadvantageous because the sharpness of the images formed deteriorates because of the increase of scattered light in the emulsion layer or because the rate of processing the photosensitive materials is reduced due to the increase in the thickness of the emulsion layers. Further, the formation of the dyes by these 4-equivalent couplers has the disadvantage that a strong oxidizing agent must be employed in the subsequent processing steps, because the complete formation of the dyes does not occur in a color development bath.

In order to overcome these disadvantages, use of 2-equivalent couplers, that is, couplers which require only 2 mols of exposed silver halide for forming 1 mol of the dye, has been proposed.

Two-equivalent couplers have a structure in which the coupling position, such as the p-position of a phenolic hydroxyl group or a hydrogen atom of an active methylene group in the 4-position of a 5-pyrazolone, is substituted with a releasable group. Examples of such releasable groups are sulfonamido groups as described in U.S. Pat. No. 3,737,316, imido groups as described in U.S. Pat. No. 3,749,735, sulfonyl groups as described in U.S. Pat. No. 3,622,328, aryloxy groups as described in U.S. Pat. No. 3,476,563, aryloxy groups as described in U.S. Pat. No. 3,419,391 and thiocyano groups as described in U.S. Pat. Nos. 3,214,377 and 3,253,924.

However, these known couplers are not always satisfactory, because they have the disadvantages that the coupling reactivity is insufficient, that the dispersibility is inferior resulting in difficulties on coating, that the synthesis of the couplers is very difficult, or that the storability of the color images formed is poor, etc.

SUMMARY OF THE INVENTION

A first object of the present invention is to provide novel 2-equivalent couplers having good dispersibility which do not give rise to difficulties on coating and are suitable for producing photosensitive materials for a color photographic process according to a subtractive process.

A second object of the present invention is to provide a process for forming dye images which comprises developing exposed silver halide emulsions in the presence of novel 2-equivalent couplers.

A third object of the present invention is to provide color photographic sensitive materials with silver halide emulsion layers containing novel couplers.

A fourth object of the present invention is to provide means for improving the sharpness of the resulting images by decreasing the amount of silver halide present in the photographic emulsions by using novel couplers.

A fifth object of the present invention is to provide 2-equivalent couplers having good spectral absorption characteristics which form color images having good stability to heat and high humidity on exposure for a long period of time.

A sixth object of the present invention is to provide novel couplers which form color images having high sensitivity, high gamma and high density by color development.

A seventh object of the present invention is to provide color developers containing novel 2-equivalent couplers.

It has now been found that the above objects are attained using couplers having an isothiocyanato group as a coupling releasable group. Further, it has now been found that these couplers are useful as intermediates for synthesizing other excellent couplers.

Thus, in one embodiment of this invention, the phenol and naphthol type cyan color forming couplers of the present invention comprise phenol and naphthol type cyan color forming couplers in which a hydrogen atom in the p-position, the coupling position, to a phenolic hydroxyl group is substituted with an isothiocyanato group which can be released by coupling with an aromatic primary amino developing agent.

Further, in another embodiment of this invention, the couplers according to the present invention include 5-pyrazolone or pyrazolobenzimidazole type magenta forming couplers, wherein a hydrogen atom of the active methylene group of the couplers, the coupling position, is substituted with an isothiocyanato group.

DETAILED DESCRIPTION OF THE INVENTION

Preferred couplers according to the present invention can be represented by the following formula (I)

$$A - N = C = S \qquad (I)$$

wherein A represents an image forming coupler residue containing a naphthol nucleus, a phenol nucleus, a 5-pyrazolone nucleus, or a pyrazolobenzimidazole nucleus, and the —N=C=S group is bonded to an active methylene group of the nucleus.

Of the couplers according to the present invention, particularly preferred couplers are represented by the formula (II)

$$R_1 - A_1 - N = C = S \quad \text{(II)}$$

In the formula (II), $A_1$ represents a cyan image forming coupler residue containing a phenol nucleus, a cyan image forming coupler residue containing an α-naphthol nucleus, or a residue of a 5-pyrazolone or a pyrazolobenzimidazole type magenta image forming coupler. The —N=C=S group is bonded to the coupling position of each coupler residue.

$R_1$ is a hydrogen atom, an alkyl group having 30 or less carbon atoms and, particularly, an alkyl group having 1 to 20 carbon atoms (for example, methyl, isopropyl, pentadecyl or eicosyl, etc.), an alkoxy group having 30 or less carbon atoms and, particularly, an alkoxy group having 1 to 20 carbon atoms (for example, methoxy, isopropoxy, pentadecyloxy or eicosyloxy, etc.), an aryloxy group (for example, phenoxy or p-tert-butylphenoxy, etc.), wherein the above-described groups may be substituted with one or more of a halogen atom (for example, chlorine, bromine, iodine or fluorine), a nitro group, a cyano group, a hydroxy group, a carboxy group, an amino group (for example, amino, alkylamino (such as, methylamino, ethylamino, etc.), dialkylamino (such as, dimethylamino, diethylamino, N-methyl-N-isopropyl amino, etc.), anilino, or N-alkylanilino (such as N-methylanilino, N-ethylanilino, etc), etc.), an aryl group (for example, phenyl, etc.), an alkoxycarbonyl group (such as methoxycarbonyl, ethoxycarbonyl, etc.), an acyloxycarbonyl group (such as acetoxycarbonyl, propionyloxycarbonyl, etc.), an amido group (for example, alkylcarbonamido (such as acetamido, etc.), alkylsulfamido (such as methanesulfonamido, etc.), etc.), an imido group (for example, succinimido, etc.), a carbamoyl group (for example, alkylcarbamoyl (such as ethylcarbamoyl or N,N-dihexylcarbamoyl, etc.), arylcarbamoyl (such as phenylcarbamoyl or N-methyl-N-phenylcarbamoyl, etc.), etc.), a sulfamoyl group (for example, alkylsulfamoyl (such as methylsulfamoyl or N,N-diethylsulfamoyl, etc.), arylsulfamoyl (such as phenylsulfamoyl or N-methyl-N-phenylsulfamoyl, etc.), etc.), an alkoxy group (for example, ethoxy or octadecyloxy, etc.) or an aryloxy group (for example, phenoxy, p-tert-butylphenoxy or 4-hydroxy-3-tert-butylphenoxy, etc.). Further, $R_1$ is an acylamino group represented by the following formulae (IV) to (VII)

| | |
|---|---|
| —NH—CO—X | (IV) |
| —NH—$SO_2$—X | (V) |
| 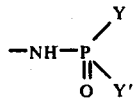 | (VI) |
| —NHCONH—X | (VII) |

or a carbamoyl group represented by the following formulae (VIII) or (IX)

| | |
|---|---|
| —CONHX | (VIII) |

-continued

| | |
|---|---|
| 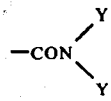 | (IX) |

wherein X represents a straight or branched alkyl group having 1 to 32 and preferably 1 to 20 carbon atoms (for example, as described above for $R_1$), a cycloalkyl group (for example, cyclopropyl, cyclohexyl or norbornyl, etc.), or an aryl group (for example, phenyl or naphthyl, etc.), wherein the above-described alkyl group or aryl group may be substituted with the substituents as defined above for $R_1$; Y and Y' each represents the above-described X group or an —OX group, a —NH—X group or an —$NX_2$ group. $R_1$ may contain conventional substituents in addition to the above-described substituents.

Of the compounds represented by the above formula (II), particularly preferred compounds are represented by the formulae (X), (XI), (XII) and (XIII)

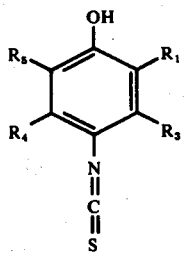
(X)

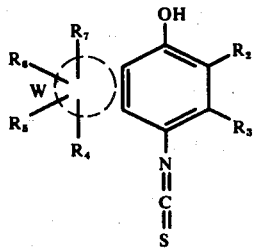
(XI)

In the formulae (X) and (XI), $R_1$ has the same meaning as in the formula (II). $R_2$ is a hydrogen atom, an alkyl group having 30 or less carbon atoms and, particularly, an alkyl group having 1 to 20 carbon atoms (e.g., as described for $R_1$), and carbamoyl groups represented by the formulae (VIII) and (IX) as described for $R_1$ in the formula (II), $R_3$, $R_4$, $R_5$, $R_6$ and $R_7$ each represents a hydrogen atom, a halogen atom, an alkyl group, an aryl group, an alkoxy group, an alkylthio group, a heterocyclic group, an amino group, a carbonamide group, a sulfonamido group, a sulfamoyl group or a carbamoyl group. W represents a group of nonmetal atoms necessary to form a 5- or 6-membered ring.

Suitable examples of $R_3$, $R_4$, $R_5$, $R_6$ and $R_7$ are a hydrogen atom, a primary, secondary or tertiary alkyl group having 1 to 22 carbon atoms (for example, unsubstituted alkyl (such as methyl, propyl, isopropyl, n-butyl, sec-butyl, tertbutyl, hexyl, dodecyl, etc.), haloalkyl (such as 2-chlorobutyl, etc.), hydroxyalkyl (such as 2-hydroxyethyl, etc.), arylalkyl (such as 2-phenylethyl, 2-(2,4,6-trichlorophenyl)ethyl, etc.), or aminoalkyl (such as 2-aminoethyl, etc.)), a aryl group (for example, phenyl- 4-methylphenyl, 2,4,6-trichlorophenyl, 3,5-dibromophenyl, 4-trifluoromethylphenyl, 2-trifluoromethylphenyl, 3-trifluoromethylphenyl, naphthyl, 2-chloronaphthyl or 3-ethylnaphthyl, etc.), or a heterocyclic group (for example, containing one or more of an oxygen, a sulfur or a nitrogen atom (such as a benzofuranyl group, a furanyl group, a thiazolyl group, a benzothiazolyl group, a naphthothiazolyl group, an oxazolyl group, a benzoxazolyl group, a naphthoxazolyl group, a pyridyl group or a quinonyl group, etc.)). Also, $R_3$ to $R_7$ represents an amino group (for example, amino, alkylamino (such as methylamino, dodecylamino, etc.), dialkylamino (such as diethylamino, etc.), arylamino (such as phenylamino, tolylamino, 4-(3-sulfobenzamido) anilino, 4-cyanophenylamino, 2-trifluoromethylphenylamino, etc.), heterocyclic amino (such as benzothiazolamino, etc.), etc.), a carbonamido group (for example, alkylcarbonamido (such as ethylcarbonamido, decylcarbonamido, phenylethylcarbonamido, etc.), aryl carbonamido (such as phenylcarbonamido, 2,4,6-trichlorophenylcarbonamido, 4-methylphenylcarbonamido, 2-ethoxyphenylcarbonamido, 3-[(2,4-ditertamylphenoxy)acetamido]benzamido, naphthylcarbonamido, etc.), heterocyclic carbonamido (such as thiazolylcarbonamido, benzothiazolylcarbonamido, naphthothiazolylcarbonamido, oxazolylcarbonamido, benzoxazolylcarbonamido, imidazolylcarbonamido, benzimidazolylcarbonamido, etc.), etc.), a sulfonamido group (for example, alkylsulfonamido (such as butylsulfonamido, dodecylsulfonamido, phenylethylsulfonamido, etc.), arylsulfonamido (such as phenylsulfonamido, 2,4,6-trichlorophenylsulfonamido, 2-methoxyphenylsulfonamido, 3-carboxyphenylsulfonamido, naphthylsulfonamido, etc.), heterocyclic sulfonamido (such as thiazolylsulfonamido, benzothiazolylsulfonamido, imidazolylsulfonamido, benzimidazolylsulfonamido, pyridylsulfonamido, etc.), etc.), an alkylsulfamoyl group (for example, propylsulfamoyl, octylsulfamoyl, pentadecylsulfamoyl, octadecylsulfamoyl, etc.), an arylsulfamoyl group (for example, phenylsulfamoyl, 2,4,6-trichlorophenylsulfamoyl, 2-methoxyphenylsulfamoyl, naphthylsulfamoyl, etc.), a heterocyclic sulfamoyl group (for example, thiazolylsulfamoyl, benzothiazolylsulfamoyl, oxazolylsulfamoyl, benzimidazolylsulfamoyl, pyridylsulfamoyl, etc.), an alkylcarbamoyl group (for example, ethylcarbamoyl, octylcarbamoyl, pentadecylcarbamoyl, octadecylcarbamoyl, etc.), an arylcarbamoyl group (for example, phenylcarbamoyl, 2,4,6-trichlorophenylcarbamoyl, etc.) or a heterocyclic carbamoyl group (for example, thiazolylcarbamoyl, benzothiazolylcarbamoyl, oxazolylcarbamoyl, imidazolylcarbamoyl, benzimidazolylcarbamoyl, etc.).

W represents a group of non-metal atoms necessary to form a fused 5- or 6-membered ring, that is, a carbocyclic or heterocyclic ring such as a benzene ring, a cyclohexene ring, a cyclopentene ring, a thiazole ring, an oxazole ring, an imidazole ring, a pyridine ring, a pyrole ring or a tetrahydropyridine ring, etc.

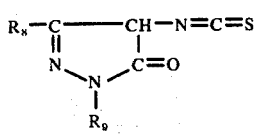
(XII)

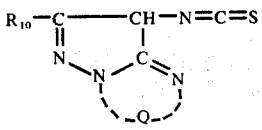
(XIII)

In the formulae (XII) and (XIII), $R_8$ and $R_{10}$ each represents an alkyl group having 30 or less carbon atoms, particularly 1 to 20 carbon atoms, which may be substituted or unsubstituted, e.g., as described for $R_1$, an alkoxy group having 30 or less carbon atoms, preferably 1 to 20 carbon atoms (such as methoxy, ethoxy, pentadecyloxy, etc.), a ureido group (for example, alkylureido (such as ethylureido, etc.) or arylureido (such as 3-acetamidophenylureido, etc.) or a substituted amino group (for example, alkylamino (such as, ethylamino, n-tetradecylamino, etc.), dialkylamino (such as, di-ethylamino, di-butylamino, etc.), cyclic alkylamino (such as, morpholino, pyrrolidino, etc.), arylamino (such as, anilino, N-methylanilino, etc.), acylamino (such as, acetylamino, benzoylamino, etc.), N-alkylacylamino (such as N-methylacetylamino, N-ethylbenzoylamino, etc.) group). $R_9$ represents an alkyl group having 1 to 20 carbon atoms (such as methyl, ethyl, etc.), an aralkyl group (such as benzyl, etc.), an aryl group (such as phenyl, naphthyl, etc.) or a heterocyclic group (such as pyrimidinyl, thiazolyl, quinolinyl, triazolyl, etc.). Examples of aryl groups for $R_9$ include a phenyl group and a naphthyl group, which may be substituted. Examples of suitable aryl group substituents for $R_9$ include one or more of those aryl group substituents hereinbefore described for the aryl group of $R_1$. Q represents a group of atoms necessary to form a heterocyclic ring (such as a benzimidazole ring).

Typical examples of the couplers of the present invention are described in the following, however, the couplers of this invention are not to be construed as being limited to these examples.

Coupler (1)

4-Isothiocyanato-2-methylphenol

Coupler (2)

2-Butyramido-4-isothiocyanatophenol

Coupler (3)

1-Hydroxy-4-isothiocyanato-N-butyl-2-naphthamide

Coupler (4)

1-Hydroxy-4-isothiocyanato-N-[γ-(2,4-di-tert-amylphenoxy)-propyl]-2-naphthamide

Coupler (5)

1 Hydroxy-4-isothiocyanato-(2'-tetradecyloxy)-2-naphthanilide

Coupler (6)

4-Isothiocyanato-3-methyl-6-[α-(2,4-di-tert-amylphenoxy)butyramido]phenol

Coupler (7)

2-Phenylsulfonylamino-4-isothiocyanato-phenol

Coupler (8)

4-Isothiocyanato-7-n-octadecylthio-1-naphthol

Coupler (9)

4-Isothiocyanato-2-phenylureido-5-[α-(2,4-di-tert-amylphenoxy) butyramido]phenol Coupler (10)

1-Hydroxy-4-isothiocyanato-(2'-chloro-5'-hexadecyloxycarbonyl) -2-naphthanilide

Coupler (11)

2-Heptafluorobutyramido-4-isothiocyanato-5-[α-(3-tert-butyl-4-hydroxyphenoxy)tetradecanamido]phenol Coupler (12)

2-Chloro-4-isothiocyanato-3-methyl-6-[α-(2,4-di-tert-amylphenoxy)butyramido]phenol Coupler (13)

N-n-Hexadecyl-N-cyanoethyl-1-hydroxy-4-isothiocyanato-2-naphthamide

Coupler (14)

1-Hydroxy-4-isothiocyanato-N-[2-(1-octadecenylsuccinmonoamide)ethyl]-2-naphthamide Coupler (15)

1-(2,4,6-Trichlorophenyl)-3-{3-[(2,4-di-tert-amylphenoxy)-acetamido]benzamido}-4-isothiocyanato-5-pyrazolone Coupler (16)

1-(2,4,6-Trichlorophenyl)-3-[2-chloro-5-(n-tetradecanamido)-anilino]-4-isothiocyanato-5-pyrazolone Coupler (17)

2-[2-Methoxy-5-(n-tetradecanamido)anilino]-3H-3-isothiocyanato-(1,5a)-benzimidazole The phenolic, α-naphtholic, 5-pyrazolonic and pyrazobenzimidazolic couplers of the present invention can be synthesized according to the following schematic $$A-NH_2 + CS_2 + C_6H_{11}-N=C=N-C_6H_{11} \longrightarrow A-N=C=S + C_6H_{11}-NH-\underset{\underset{S}{\|}}{C}-NH-C_6H_{11}$$

wherein A has the same meaning as defined above, as described in Chem. Ber., Vol. 101, page 1746 (1968). That is, an $A-NH_2$ compound can be reacted with an equimolar amount of dicyclohexylcarbodiimide and about 5 molar equivalents of carbon disulfide to obtain an isothiocyanate derivative of the formula (I). Representative synthetic processes for the coupler employed in the present invention are set forth below, but the invention is not to be construed as being limited to these examples. Unless otherwise indicated herein, all parts, percents, ratios and the like are by weight.

SYNTHESIS EXAMPLE

Synthesis of 1-Hydroxy-4-isothiocyanato-N-[γ-(2,4-ti-tertamylphenoxy)propyl]-2-naphthamide:

a. Synthesis of 1-Hydroxy-4-nitro-N-[γ-(2,4-di-tert-amylphenoxy)-propyl]-2-naphthamide 100 g of 1-hydroxy-N-V-(2,4-di-tert-amylphenoxy)-propyl]-2-naphthamide was dissolved in 1 liter of acetic acid and nitrated at 15°–18° C using 23 g of a 60% nitric acid aqueous solution. After the completion of the reaction, 1 liter of methanol was added thereto and precipitated crystals were separated by filtration. After recrystallization from a 2:1 by volume solvent mixture composed of ethyl acetate and methanol, 70 g of the titled compound was obtained. The melting point was 209°–210° C.

b. Synthesis of 1-Hydroxy-4-amino-N-[γ-(2,4-di-tert-amylphenoxy)-propyl]-2-naphthamide:

50 g of 1-hydroxy-4-nitro-N-[γ-(2,4-di-tert-amylphenoxy)propyl]-2-naphthamide was reduced using 50 g of reduced iron in 500 ml of a 90% acetic acid aqueous solution. The reaction mixture was poured into water and extracted with ethyl acetate. Then the ethyl acetate was removed by distillation and the residue was recrystallized from ligroin to obtain 40 g of the titled compound. The melting point was 132°–133° C.

c. Synthesis of 1-Hydroxy-4-isothiocyanato-N-[γ-(2,4-di-tert-amylphenoxy)propyl]-2-naphthamide:

A mixture of 20.6 g of dicyclohexylcarbodiimide, 20 ml of pyridine and 40 ml of carbon disulfide was cooled to −10° C. To this mixture, a solution of 47.6 g of 1 -hydroxy-4-amino-N-]γ-(2,4-di-tert-amylphenoxy)-propyl]-2-naphthamide in 100 ml of pyridine was added with stirring. After conclusion of the reaction, the solvent was removed by distillation and 100 cc of ethyl acetate was added to the residue. After filtration, the filtrate was condensed. 200 ml of acetonitrile was added to the residue and the precipitated crystals were separated by filtration to obtain 42 g of the titled compound. The melting point was 91°–94° C.

The silver halide emulsions used in the present invention can be produced by mixing a solution of a water-soluble silver salt (for example, silver nitrate) with a solution of a water-soluble halogen salt (for example, potassium bromide) in the presence of a solution of a water-soluble high molecular weight material such as gelatin. Not only silver chloride and silver bromide but also mixed silver halides such as silver bromochloride, silver iodobromide and silver iodobromochloride can be used as the silver halide. The grains of these silver halide may be a cubic system, an octahedral system or a mixed crystal system.

A uniform grain size is not necessary and these silver halide grains can be produced according to known conventional processes. A single or double jet process or a control double jet process is preferred for producing the silver halide.

Also, two or more silver halide photographic emulsions which were prepared separately can be used. Further, the silver halide grains may have a homogeneous crystal structure or a stratum structure wherein the interior and the outer portion thereof are different, or may be the so-called conversion type grains described in British Pat. No. 635,841 or U.S. Pat. No. 3,622,318. Futther, silver halide grains wherein latent images are formed on the surface thereof or those wherein latent images are formed in the interior thereof can be used. These photographic emulsions are described in C.E.K. Mees & T.H. James, *The Theory of the Photographic Process*, 3rd Ed., Macmillan Co., New York (1966), P. Grafkides, *Chimie Photographique*, Paul Montel Co., Paris (1957), and can be prepared by various processes such as an ammonia process, a neutral process or an acid process, etc.

After formation of the silver halide grains, watersoluble salts as by-products (for example, potassium nitrate where silver bromide is produced using silver nitrate and potassium bromide) are removed from the system by washing with water. Then, they are heated in the presence of a chemical sensitizer such as sodium thiosulfate, N,N,N'-trimethylthiourea, an aurous thiocyanate complex salt, an aurous thiosulfate complex salt, stannous chloride or hexamethylenetetramine to increase the sensitivity without coarsening the grain size. This method is described in Mees & James, supra and Glafkides, supra.

Examples of hydrophilic high molecular weight materials for the photosensitive layers of the present invention include, for example, gelatin, colloidal albumin, casein, cellulose derivatives such as carboxymethyl cellulose or hydroxyethyl cellulose, agar-agar, sodium alginate, saccharose derivatives such as starch derivatives, and synthetic hydrophilic colloids such as polyvinyl alcohol, poly-N-vinylpyrrolidone, polyacrylic acid copolymers, polyacrylamide and the derivatives thereof or the partially hydrolyzed products thereof, etc. If desired, a compatible mixture of two or more of these colloids can be used.

Of these materials, gelatin is most commonly used. However, a portion or all of the gelatin can be replaced by not only synthetic high molecular weight materials but also gelatin derivatives, that is, those gelatins modified with compounds reactive with the amino groups, imino groups, hydroxyl groups or carboxyl groups as functional groups in the gelatin molecule or graft polymers of gelatin to which the polymer chains of another high molecular weight material have been grafted.

Examples of compounds for preparing the above-described gelatin derivatives include, for example, isocyanates, acid chlorides and acid anhydrides described in U.S. Pat. No. 2,614,928, acid anhydrides described in U.S. Pat. No. 3,118,766, bromoacetic acids described in Japanese Patent Publication 5514/1964, phenyl glycidyl ethers described in Japanese Patent Publication 26845/1967, vinyl sulfone compounds described in U.S. Pat. No. 3,132,945, N-allyl vinylsulfonamides described in British Pat. No. 861,414, maleinimide compounds described in U.S. Pat. No. 3,186,846, acrylonitriles described in U.S. Pat. No. 2,594,293, polyalkylene oxides described in U.S. Pat. No. 3,312,553, epoxy compounds described in Japanese Patent Publication 26845/1967, acid esters described in U.S. Pat. No. 2,763,639 and alkane sultones described in British Pat. No. 1,033,189.

Examples of high molecular weight materials which can be grafted to gelatin are described in U.S. Pats. 2,831,767 and 2,956,884, *Polymer Letters*, 5, 595 (1967), *Phot. Sci. Eng.*, 9, 148 (1965) and *J. Polymer Sci.*, *A*-1, 9, 3199 (1971), and polymers or copolymers of vinyl monomers such as acrylic acid, methacrylic acid, the esters, amides and nitriles thereof or styrene can be widely used as such a material. However, hydrophilic vinyl polymers which are compatible with gelatin, such as polymers or copolymers of acrylamide, acrylic acid, methacrylamide, hydroxyalkyl acrylates and hydroxyalkyl methacrylates, etc., are particularly preferred.

If desired, the photographic emulsions can be spectrally sensitized or supersensitized using cyanine dyes such as cyanine, merocyanine or carbocyanine dyes, individually, or in combination or using a combination of cyanine dyes and a styryl dye. These color sensitization techniques are well known and are described in, for example, U.S. Pats. 2,493,748, 2,519,001, 2,977,229, 3,480,434, 3,672,897, 3,703,377, 2,688,545, 2,912,329, 3,397,060, 3,615,635, and 3,628,964, British Pat. Nos. 1,195,302, 1,242,588 and 1,293,862, West German Patent Applications (OLS) 2,030,326 and 2,121,780, Japanese Patent Publications 4936/1968, 14030/1969 and 10773/1968, U.S. Pat. Nos. 3,511,664 3,522,052, 3,527,641, 3,615,613, 3,615,632, 3,617,295, 3,635,721, and 3,694,217, and British Pat. Nos. 1,137,580 and 1,216,203. These techniques can be suitably selected depending on the purpose and the use of the photosensitive materials, such as the wavelength to be sensitized, the sensitivity desired, etc.

It is possible to add various compounds to the emulsions in order to prevent a deterioration of the sensitivity or a generation of fcg during the preparation of the photosensitive materials, during the storage thereof or during the processing thereof. Quite a large number of known compounds such as heterocyclic compounds including 4-hydroxy-6-methyl1,3,3a,7-tetrazaindene, 3-methylbenzothiazole and 1-phenyl-5-mercaptotetrazole, mercury containing compounds, mercapto compounds or metal salts, etc., can be used for this purpose. Examples of compounds which can be used are in C.E.K. Mees & T.H. James, *The Theory of the Photographic Process*, 3rd Ed., pages 334–349, Macmillan, New York (1966) and in the following patents: U.S. Pat. Nos. 1,758,576, 2,110,178, 2,131,038, 2,173,628, 2,697,040, 2,304,962, 2,324,123, 2,394,198, 2,444,605–2,444,608, 2,566,245, 2,694,716, 3,697,099, 2,708,162, 2,728,663 2,728,665, 2,476,536, 2,824,001, 2,843,491, 3,052,544, 3,137,577, 3,220,839, 3,226,231, 3,236,652, 3,251,691, 3,252,799, 3,287,135, 3,326,681, 3,420,668 and 3,622,339, and British Pat. Nos. 893,428, 403,789, 1,173,609 and 1,200,188.

The photographic emulsion layers and other layers used in the present invention can contain synthetic polymer compounds, for example, water-dispersible vinyl polymer latexes and, particularly, compounds for increasing the dimensional stability of the photographic materials, either individually or as a mixture of two or more thereof or together with hydrophilic water-permeable colloids. Many examples of such polymers are described in U.S. Pat. No. 2,376,005, 2,739,137, 2,853,457, 3,062,674, 3,411,911, 3,488,708, 3,525,620, 3,635,715, 3,607,290 and 3,645,740, and British Pat. Nos. 1,186,699 and 1,307,373. Of these polymers, homopolymers and copolymers of alkyl acrylates, alkyl methacrylates, acrylic acid, methacrylic acid, sulfoalkyl acrylates, sulfoalkyl methacrylates, glycidyl acrylate, glycidyl methacrylate, hydroxyalkyl acrylates, hydroxyalkyl methacrylates, alkoxyalkyl acrylates, alkoxyalkyl methacrylates, styrene, butadiene, vinyl chloride, vinylidene chloride, maleic acid anhydride and itaconic acid anhydride are commonly used. If desired, the so-called graft type emulsion polymerization latexes which are prepared by emulsion polymerization of vinyl compounds in the presence of a high molecular weight material protective colloid can be used.

The photographic emulsions can contain one or more surface active agents. Although these agents are generally used as coating assistants, they are sometimes used for other purposes such as for sensitization, improvement of photographic properties, prevention of the buildup of electrostatic charges or prevention of adhesion, etc.

These surface active agents can be classified as natural surface active agents such as saponin, nonionic surface active agents such as alkylene oxide type, glycerin type or glycidol type agents, cationic surface active agents such as higher alkylamines, quaternary ammonium salts or pyridinium and another heterocyclic onium compounds, phosphonium and sulfoniums, anionic surface active agents containing acid groups such as carboxylic acid groups, sulfonic acid groups, phosphoric acid groups, sulfuric acid ester groups or phosphoric acid ester groups, and ampholytic surface active agents such as aminoacids, aminosulfonic acids and sulfuric acid or phosphoric acid esters of aminoalcohols.

Examples of surface active agents which can be used are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, West German Patent Application (OLS) 1,942,665, British Pat. Nos. 1,077,317 and 1,198,450, as well as Ryohei Oda et al., *Kaimenkasseizai no Gosei to sono Oyo* (*Synthesis of Surface Active Agents and Their Applications*), Maki Shoten, Tokyo (1964), A.M. Schwartz et al., *Surface Active Agents*, Interscience Publications Incorporated (1958), and J.P. Sisley et al., *Encyclopedia of Surface Active Agents*, Vol. 2, Chemical Publishing Company (1964).

The formation of dye images in the present invention can be achieved in various kinds of photosensitive materials. One method is a process which comprises processing photosensitive materials having silver halide emulsion layers with an alkaline developer containing an aromatic primary amine color developing agent and also a coupler dissolved therein to leave waterinsoluble or non-diffusible dyes in the emulsion layers, that is, a color photographic process using a coupler-containing developer. For example, the above-described Couplers (1), (2), (3) and (7) are suitable for this process. Another process comprises processing the photosensitive materials which have silver halide emulsion layers containing non-diffusible couplers on a support with an alkaline developer containing an aromatic primary amine color developing agent to leave water-insoluble or non-diffusible dyes in the emulsion layer. For example, the above-described Couplers (4) and (6) are suitable for this process.

The phenol type couplers, the α-naphthol type couplers, the 5-pyrazolone couplers or the pyrazolobenzimidazole couplers of the present invention can be dispersed in the photographic emulsions after dissolving them in an aqueous medium or an organic solvent.

Oil soluble non-diffusible couplers used for the incorporated-coupler films are incorporated in the photosensitive materials by previously dissolving them in an organic solvent and dispersing the solution in a photographic emulsion as finely divided colloid particles.

Examples of processes for dispersing the couplers suitable for practicing the present invention are described in U.S. Pat. No. 3,676,131. Of the organic solvents used for dissolving couplers, those which are difficultly water-soluble and which have a high boiling point which are present with the couplers in the color photosensitive materials include substituted hydrocarbons, carboxylic acid esters, carboxylic acid amides, phosphoric acid esters and ethers. Examples of such compounds include di-n-butyl phthalate, di-isooctyl acetate, di-n-butyl sebacate, tricresyl phosphate, tri-n-hexyl phosphate, N,N-diethyl caprylamide, butyl-n-pentadecylphenyl ether and chlorinated paraffin. In addition to these high boiling point solvents, it is advantageous to use auxiliary solvents which can be removed during production of the photosensitive materials in order to assist the dissolution of the couplers. Examples of suitable auxiliary solvents include propylene carbonate, ethyl acetate, butyl acetate, cyclohexanol, tetrahydrofuran and cyclohexanone, etc.

It is advantageous to use surface active agents for the purpose of finely dispersing these oil soluble couplers for incorporated-coupler films in hydrophilic high molecular weight materials used for the photographic emulsions. It is particularly preferred to use anionic sufface active agents such as sodium cetyl sulfate, sodium p-dodecylbenzene sulfonate, sodium nonylnaphthalene sulfonate, or sodium di-(2-ethylhexyl)-α-sulfosuccinate, etc., and nonionic surface active agents such as sorbitan sesquioleic acid ester or sorbitan monolauric acid ester, etc.

Homogenizers for emulsification, colloid mills and ultrasonic emulsification devices are useful for dispersing the oil-soluble couplers. Non-diffusible couplers having a carboxyl group or a sulfo group together with a ballast group in the molecule are soluble in neutral or weakly alkaline aqueous solutions. By adding such an aqueous solution containing the coupler to the photographic emulsion, the coupler can be incorporated in the emulsion. It is believed that the coupler becomes non-diffusible because of the formation of micelles in the hydrophilic high molecular weight material.

Silver halide photosensitive materials to which the present invention is applicable include not only conventional color photographic materials such as color negative films, color positive films, color reversal films and color papers, etc., but also another various color photosensitive materials. In addition, the invention is applicable to direct positive photosensitive materials and monochromatic photosensitive materials.

The couplers of this invention are generally used in the emulsion in the amount of about 10 to 1500 g per mol of silver halide. However, the amount can be varied according to the purpose of use.

In the silver halide photosensitive materials used in the present invention, various photographic layers such as silver halide emulsion layers, an intermediate layer, an antihalation layer, a protective layer, a yellow filter layer, a back layer, a mordanting polymer layer and a layer for preventing contamination by the developer are applied on a support. The color silver halide emulsion layers comprise a red-sensitive silver halide emulsion layer, a green-sensitive silver halide emulsion layer and a blue-sensitive silver haldie emulsion layer. The order of these layers is not fixed, and each layer can be divided into two or more layers, if desired.

It is advantageous for increasing the stability of the color images produced that the photosensitive materials of the present invention contain p-substituted phenol derivatives in an emulsion layer thereof or adjacent layers thereto. Particularly preferred p-substituted phenol derivatives are the hydroquinone derivatives described in U.S. Pat. Nos. 2,360,290, 2,418,613, 2,675,314, 2,701,197, 2,704,713, 2,710,801, 2,728,659, 2,732,300, 2,735,765 and 2,816,028; gallic acid derivatives described in U.S. Pat. Nos. 3,457,079 and 3,069,262 and Japanese Patent Publication 13496/1968; p-alkoxyphenols described in U.S. Pat. No. 2,735,765 and Japanese Patent Publication (OPI) 4738/1972 and p-oxyphenol derivatives described in U.S. Pat. Nos. 3,432,300, 3,573,050, 3,574,627 and 3,764,337.

The photosensitive materials in the present invention preferably contain an ultraviolet light absorbing agent described in, for example, U.S. Pat. Nos. 3,250,617 and 3,253,921 in the emulsion layers or adjacent layers thereto so as to stabilize the images.

The hardening of the emulsion layers can be carried out using conventional techniques. Examples of suitable hardening agents include aldehyde compounds such as formaldehyde or glutaraldehyde, ketone compounds such as diacetyl or cyclopentanedione, reactive halogen containing compounds such as bis-(2-chloroethyl urea), 2-hydroxy-4,6-dichloro-1,3,5-triazine and the compounds described in U.S. Pat. Nos. 3,288,775, 2,732,303, 3,125,449 and 1,167,207, reactive olefin containing compounds such as divinyl sulfone, 5-acetyl-1,3-diacryloylhexahydro1,3,5-triazine and the compounds described in U.S. Pat. Nos. 3,635,718 and 3,232,763 or British Pat. Nos. 994,869, N-methylol compounds such as N-hydroxymethyl phthalimide and the compounds described in U.S. Pat. Nos. 2,732,316 and 2,586,168, isocyanates as described in U.S. Pat. No. 3,103,437, aziridine compounds as described in U.S. Pat. Nos. 3,017,280 and 2,983,611, the acid derivatives as described in U.S. Pat. Nos. 2,725,294 and 2,725,295, carbodiimide compounds as described in U.S. Pat. No. 3,100,704, epoxy compounds as described in U.S. Pat. No. 3,091,537, isoxazole compounds as described in U.S. Pat. Nos. 3,321,313 and 3,543,292, halocarboxyaldehydes such as mucochloric acid, dioxane derivatives such as dihydroxydioxane or dichlorodioxane, and inorganic hardening agents such as chromium alum or zirconium sulfate. Further, precursor type compounds, for example, alkali metal bisulfite-aldehyde addition products, methylol derivatives of hydantoin and primary aliphatic nitroalcohol, etc., can be used instead of the above-described compounds.

The photographic emulsions are coated, e.g., in an amount of about $5 \times 10^{-5}$ to about $1 \times 10^{-1}$ mol of silver halide/$m^2$ of the support, on substantially planar materials which do not undergo any large dimensional change during processing, for example, rigid supports such as glass, metal or ceramics, or flexible supports, etc. Typical examples of flexible supports include cellulose nitrate films, cellulose acetate films, cellulose acetate butyrate films, cellulose acetate propionate films, polystyrene films, polyethylene terephthalate films, polycarbonate films, laminates of these synthetic resin films, thin glass films, and paper, etc. Further, a paper which is coated or laminated with baryta or $\alpha$-olefin polymers and particularly polymers of $\alpha$-olefins having 2 to 10 carbon atoms, such as polyethylene, polypropylene or ethylene-propylene copolymers, and synthetic resin films whose surface has been roughened so as to improve adhesion to other high molecular weight materials and to improve the printability as described in Japanese Patent Publication 19068/1972 give good results as supports.

The support can be a transparent material or an opaque material according to the purpose of use of the photosensitive materials. Where transparent supports are used, not only colorless supports but also colored supports colored by adding dyes or pigments thereto can be used. This has been carried out hitherto in X-ray films and has been described in J. SMPTE., 67, 296 (1958).

Opaque supports include not only intrinsically opaque supports such as paper but also films prepared by adding dyes or pigments such as titanium oxide to transparent films, synthetic resin films, the surface of which has been processed by the method described in Japanese Patent Publication 19068/1972, and light shielding papers or synthetic resin flims containing carbon black or dyes, etc. When the adhesive strength between the support and the photographic emulsion layer is insufficient, a subbing layer which is adhesive to both of the support and the photographic layer can be employed. Further, the surface of the supports can be subjected to a corona discharge, an ultraviolet light treatment or a flame treatment, etc., for the purpose of further improving the adhesion.

In order to obtain dye images in the color photographic sensitive materials, a development processing after exposure to light is carried out. The development processing basically comprises a color development step, a bleaching step and a fixing step. Each step can be conducted separately or two or more steps can be carried out as one step using a processing solution which has functions for these steps. For example, the use of a one-bath bleach-fixing solution is one example of two steps being conducted together. Further, each step can be carried out by separating into two steps. Furthermore, it is possible to carry out the processing using the combination of a color development, a first fixing and a bleach-fixing. If desired, the development processing can include other steps such as a prehardening neutralization, a first development (black-white development), an image stabilization and a water wash, etc.

The processing temperature is selected depending on the kind of photosensitive materials and method of processing. The processing temperature is sometimes below about 18° C but is often above about 18° C. Particularly, the temperature ranges from about 20° to 60° C, and recently 30° to 60° C. The temperature of each step need not necessarily be the same.

A color developer is an alkaline aqueous solution having a pH of above about 8 and preferably 9 to 12 which contains as a developing agent a compound whose oxidation product forms a color product by reacting with a color forming coupler. When the coupler of this invention is incorporated in a color developer a suitable amount can range from about 0.2 to about 50 g, preferably 0.5 to 10 g, per liter of the developer solution.

The above-described developing agent is a compound which has a primary amino group on an aromatic ring and has the ability of developing exposed silver halide or a precursor thereof which forms such a compound. Preferred examples of developing agents include 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 4-amino-3-methyl-N-ethyl-N-$\beta$-methaneuslfonamidoethylaniline, 4-amino,N,N-dimethylaniline, 4-amino-3-methoxy-N,N-dimethylaniline, 4-amino-3-methyl-N-ethyl-N-β-methoxyethylaniline, 4-amino-3-methoxy-N-ethyl-N-β-methoxyethylaniline, 4-amino-3-β-methanesulfonamidoethyl-N,N-diethylaniline and salts thereof (for example, the sulfates, hydrochlorides, sulfites and p-toluenesulfonates, etc.). In addition, the compounds described in U.S. Pats. Nos. 2,193,015, and 2,592,364, Japanese Patent Application (OPI) 64933/1973 and L.F.A. Mason, *Photographic Processing Chemistry*, pages 226 – 229, Focal Press, London (1966) can be used.

Further, the above-described compounds can be used together with 3-pyrazolidones. If desired, various additives can be added to the color developer. Examples of such additives include alkali agents (for example, the hydroxides, carbonates or phosphates of alkali metals or ammonia), pH controlling agents or buffer agents (for example, weak acids such as acetic acid or boric acid, weak bases or the salts thereof), development accelerating agents (for example, pyridinium compounds or cationic compounds described in U.S. Pat. Nos. 2,648,604 and 3,671,247, potassium nitrate or sodium nitrate, polyethylene glycol condensates or derivatives thereof described in U.S. Pat. Nos. 2,533,990, 2,577,127 and 2,950,970, nonionic compounds such as polythioethers represented by the compounds described in British Pat. Nos. 1,020,033 and 1,020,032, sulfite ester containing polymer compounds represented by the compounds described in U.S. Pat. No. 3,068,097, organic amines such as pyridine or ethanolamine, benzyl alcohol or hydrazines, etc.), antifogging agents (for example, alkali metal bromides or alkali metal iodides, nitrobenzimidazoles described in U.S. Pat. No. 2,496,940, mercaptobenzimidazole, 5-methyl-benzotriazole or 1-phenyl-5-mercaptotetrazole, compounds for rapid processing solutions described in U.S. Pat. Nos. 3,342,596, 3,295,976, 3,615,522 and 3,597,199, thiosulfonyl compounds described in British Pat. No. 972,211, phenazine-N-oxides described in Japanese Patent Publication 41675/1971, and antifogging agents described in *Kagakushashin Binran* (*Handbook of Photographic Science*), Vol. 2, pages 29 – 47, stain or sludge inhibiting agents described in U.S. Pat. Nos. 3,161,513 and 3,161,514 and British Pat. Nos. 1,144,481, 1,030,442 and 1,251,558, interlayer-effect accelerating agents described in U.S. Pat. No. 3,536,487 and preservatives (for example, sulfites, bisulfites, hydroxylamine hydrochloride or alkanolamine-sulfite addition products, etc.).

After the color development has been conducted, the photosensitive materials of the present invention are subjected to a bleaching in a conventional method. This processing can be carried out separately or simultaneously with the fixing.

It is possible, if desired, to add a fixing agent to this processing solution to make a bleach-fix bath or blixing bath. Many compounds can be used as bleaching agents. For example, ferricyanides, bichromates, water-soluble cobalt (III) salts, water-soluble copper (II) salts, water-soluble quinones, nitrosophenols, polyvalent metal compounds such as of iron (III), cobalt (III) or copper (II), etc., and particularly, complex salts of these polyvalent metal cations and organic acids, for example, metal complex salts of aminopolycarboxylic acids such as ethylenediamine tetraacetic acid, nitrilotriacetic acid, iminodiacetic acid, or N-hydroxyethyl ethylenediamine triacetic acid, etc., malonic acid, tartaric acid, malic acid, diglycolic acid or dithioglycolic acid, etc., and a 2,6-dipicoline copper complex salt, etc., peracids, for example, alkyl peracids, persulfates, permanganates, and hydrogen peroxide, etc., hypochlorites, chlorine, bromine, etc., can be used, individually or as a suitable combination thereof. It is also possible to add to this processing solution a bleaching accelerating agent described in U.S. Pat. Nos. 3,042,520 and 3,241,966 and Japanese Patent Publications 8506/1970 and 8836/1970 and other various additives.

The couplers of the present invention can be used for photosensitive materials having a low silver content wherein the amount of silver halide in the emulsion is from about 1/2 to about 1/100 lower than that in conventional photosensitive materials.

In using photosensitive materials having a low silver halide content, it is possible to utilize a development process which comprises halogenation-bleaching the developed images formed by color development and then color developing again to increase the amount of dye formed, a development process which comprises intensifying the image formed using a peroxide or a cobalt complex salt, for example, such as those described in U.S. Pat. Nos. 3,674,490, and 3,761,265, West German Patent Applications (OLS) 2,044,833, 2,056,359, 2,056,360 and 2,226,770, Japanese Patent Applications (OPI) 9728/1973 and 9729/1973, and West German Patent Application (OLS) 2,357,694.

The present invention will be illustrated by reference to the following non-limiting examples.

EXAMPLE 1

10 g of Coupler (4) was dissolved in a mixture of 10 ml of tricresyl phosphate and 20 ml of ethyl acetate. 20 ml of a 20% methanol solution of sorbitan laurate was added to the solution and the mixture was mixed with 100 g of a 10 wt % aqueous gelatin solution and 10 ml of a 5% aqueous solution of sodium dodecylbenzene sulfonate. The mixture was emulsified using a homogenizer in a conventional manner.

This emulsified dispersion was added to 500 g of a silver halide emulsion containing 0.2 mol of silver iodobromide grains containing 7% by mol of iodide having an average particle size of 0.5 μ and 30 g of gelatin. Then, 30 ml of a 2% methanol solution of 5-methyl-7-hydroxy-1,3,4,7a-tetrazaindene, 20 ml of a 2% aqueous solution of potassium polystyrene sulfonate, 10 ml of a 5% aqueous solution of sodium dodecylbenzene sulfonate and 40 ml of a 2 wt % aqueous solution of sodium 1-hydroxy-3,5-dichloro-s-triazine were added thereto and the final pH was adjusted to 6.5. The mixture was applied to a cellulose triacetate support and dried to obtain a sample having a film thickness of 3 μ.

In order to compare with a coupling position unsubstituted type coupler having the same structure, it was exposed to a step wedge in a conventional manner and developed as follows.

| Development Processing Steps | Temperature (° C) | Time |
|---|---|---|
| Color Development | 21 | 12 minutes |
| Water Wash | " | 30 seconds |
| First Fixing | " | 4 minutes |
| Water Wash | " | 4 minutes |
| Bleaching | " | 8 minutes |
| Water Wash | " | 4 minutes |
| Second Fixing | " | 4 minutes |
| Water Wash | " | 20 minutes |
| Drying | " | |

The compositions of the solutions used in the above steps were as follows.

| | |
|---|---|
| Color Developer | |
| Benzyl Alcohol | 3.8 ml |
| Sodium Hexametaphosphate | 2.0 g |
| Sodium Sulfite (anhydrous) | 2.0 g |
| Sodium Carbonate (monohydrate) | 50.0 g |
| N-Ethyl-N-β-methanesulfonamidoethyl-3-methyl-4-aminoanilino Sulfate | 5.0 g |
| Potassium Bromide | 1.0 g |
| Water to make | 1 l |
| Fixing Solution (for first fixing and second fixing) | |
| Sodium Thiosulfate (anhydrous) | 153 g |
| Sodium Sulfite (anhydrous) | 15 g |
| Glacial Acetic Acid | 13.5 ml |
| Boric Acid | 7.5 g |
| Potassium Alum | 15 g |
| Water to make | 1 l |
| Bleaching Solution | |
| Potassium Ferricyanide | 50 g |
| Potassium Bromide | 20 g |
| Water to make | 1 l |

The results shown in Table 1 were obtained in carrying out the above-described processings.

TABLE 1

| Coupler | $\lambda_{max}$ (nm) | $D_{max}$ | Relative Speed | Fog | Gamma |
|---|---|---|---|---|---|
| Coupler (4) | 695 | 3.10 | 125 | 0.08 | 2.2 |
| Coupling Position Unsubstituted-Type Coupler | 695 | 2.05 | 100 | 0.10 | 2.0 |

It can be understood from the results in Table 1 that Coupler (4) is superior to the coupling position unsubstituted type coupler from the standpoint of relative speed, gamma and $D_{max}$ notwithstanding less emulsion fog, and, therefore, it has excellent characteristics as a coupling position substituted type coupler.

When the same procedures were carried out using the Coupler (5), (6) or (11) instead of Coupler (4), the emulsion fog was less and the relative speed, gamma and $D_{max}$ were superior to those obtained with the coupling position unsubstituted type couplers.

EXAMPLE 2

The coated sample of Example 1 was stored in the dark at 40° C and 75% relative humidity for 4 days. Then, the sample was exposed to light and processed in the same manner as in Example 1. The results are shown in Table 2.

TABLE 2

| Coupler | $D_{max}$ | Relative Speed | Fog | Gamma |
|---|---|---|---|---|
| Coupler (4) | 3.05 | 125 | 0.09 | 2.1 |
| Coupling Position Unsubstituted-Type Coupler | 1.90 | 95 | 0.12 | 1.9 |

As is clear from the results in Tables 1 and 2, Coupler (4) is superior to the coupling position unsubstituted type coupler, because the changes of photographic properties of the unexposed photosensitive material such as $D_{max}$, relative speed, fog and gamma are less even though the material was stored under severe conditions of 40° C and 75% relative humidity for 4 days, and consequently, a stable photosensitive material could be produced.

EXAMPLE 3

A coated sample was produced using a coupler whose coupling position was substituted with chlorine (hereinafter chlorine-substituted type coupler) in the same manner as in Example 1. The sample was exposed uniformly to light together with the coated sample of Example 1 and subjected to the following color development processing. The processing solutions used were the same as in Example 1.

| Development Processing Step | Temperature (° C) | Time |
|---|---|---|
| Color Development | 21 | 12 minutes |
| Water Wash | " | 30 seconds |
| First Fixing | " | 4 minutes |
| Water Wash | " | 20 minutes |
| Drying | | |

The amount of developed silver per unit area of each processed sample was determined using a fluorescence X-ray counting meter and the amount of developed dye was determined using a spectrophotometric method after extraction of the dye formed with a solvent mixture of N,N-dimethylformamide and water (85:15 by volume). The results obtained are shown in Table 3 below.

TABLE 3

| Coupler | Amount of Developed Silver (A) (mol/m²) | Amount of Developed Dye (B) (mol/m²) | Molar Ratio (A)/(B) |
|---|---|---|---|
| Coupler (4) | $1.54 \times 10^{-2}$ | $0.55 \times 10^{-3}$ | 2.8 |
| Chlorine Substituted Type Coupler | $160 \times 10^{-2}$ | $0.50 \times 10^{-2}$ | 3.2 |
| Unsubstituted Type Coupler | $2.12 \times 10^{-2}$ | $0.40 \times 10^{-2}$ | 5.3 |

As is clear from the results in Table 3, the amount of developed silver necessary to obtain the same amount of developed dye, that is, the same color density is about half (53%) that required for the unsubstituted type coupler. Further, the amount of developed silver is 87% of the case of the chlorine substituted type coupler. Accordingly, it is possible to decrease the amount of silver coated by using Coupler (4).

EXAMPLE 4

Emulsified dispersions were produced using Coupler (15) and an unsubstituted type coupler in the same manner as in Example 1 and coated on supports. These samples were exposed to light and subjected to the color development processing described in Example 1. The results obtained are shown in Table 4.

TABLE 4

| Coupler | $\lambda_{max}$ (nm) | $D_{max}$ | Relative Speed | Fog | Gamma |
|---|---|---|---|---|---|
| Coupler (15) | 550 | 3.45 | 110 | 0.06 | 2.6 |
| Unsubstituted Type Coupler | 550 | 2.80 | 100 | 0.07 | 2.5 |

As is clear from the results in Table 4, the emulsion fog using Coupler (15) is less and the properties such as relative speed, $D_{max}$ and gamma are excellent.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing at least one color coupler of the formula (I)

$$A - N = C = S \qquad (I)$$

wherein A represents an image forming coupler residue containing a naphthol nucleus, a phenol nucleus, a 5-pyrazolone nucleus, or a pyrazolobenzimidazole nucleus and the —N=C=S group is bonded to the coupling position of the nucleus.

2. The silver halide photographic emulsion of claim 1, wherein said coupler is represented by the formula (II)

$$R_1 - A_1 - N = C = S \qquad (II)$$

wherein $A_1$ represents a cyan image forming coupler residue containing a phenol nucleus, a cyan image forming coupler residue containing an $\alpha$-naphthol nucleus, a magenta image forming coupler residue containing a 5-pyrazolone nucleus or a magenta image forming coupler containing a pyrazolobenzimidazole nucleus; the —N=C=S group is bonded to the coupling position of the coupler residue; $R_1$ is a hydrogen atom, an alkyl group, an alkoxy group, or an aryloxy group, wherein said alkyl, alkoxy, and aryloxy groups may be substituted with one or more of a halogen atom, a nitro group, a cyano group, a hydroxy group, a carboxy group, an aryl group, an alkoxycarbonyl group, an acyloxycarbonyl group, an amino group, an alkylamino group, a dialkylamino group, an arylamino group, an N-(alkyl)arylamino group, a carbonamido group, a sulfonamido group, an imido group, a carbamoyl group, a sulfamoyl group, an alkoxy group or an aryloxy group, or an acylamino group represented by the following formulae (IV) to (VII)

| | |
|---|---|
| $-NH-CO-X$ | (IV) |
| $-NH-SO_2-X$ | (V) |
| $-NH-P(=O)(Y)(Y')$ | (VI) |
| $-NHCONH-X$ | (VII) |

or a carbamoyl group represented by the following formula (VIII) or (IX)

| | |
|---|---|
| $-CONHX$ | (VIII) |
| $-CON(Y)(Y')$ | (IX) |

wherein X represents an alkyl group or an aryl group, in which the alkyl group may be a straight chain, branched chain or cyclic alkyl group and where the alkyl group and the aryl group may be substituted with one or more of a halogen atom, a nitro group, a cyano group, a hydroxy group, a carboxy group, an amino group, an alkylamino group, a dialkylamino group, an arylamino group, an N-(alkyl)arylamino group, an aryl group, an alkoxycarbonyl group, an acyloxycarbonyl group, a carbonamido group, a sulfonamido group, an imido group, a carbamoyl group, a sulfamoyl group, an alkoxy group, or an aryloxy group; and Y and Y' each represents the above described X group or an —OX group, an —NH-X group or an $-NX_2$ group.

3. The silver halide photographic emulsion of claim 2, wherein said color coupler is represented by the formula (X), (XI), (XII) or (XIII)

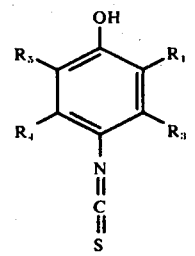
(X)

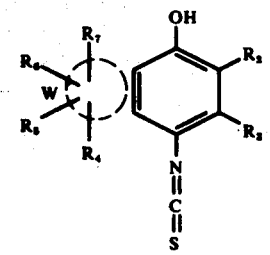
(XI)

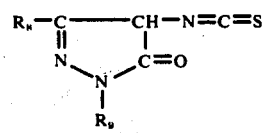
(XII)

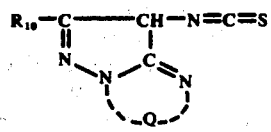
(XIII)

wherein $R_1$ is as described above; $R_2$ represents a hydrogen atom, an alkyl group, or a carbamoyl group represented by the formula (VIII) or (IX) as described above; $R_3$, $R_4$, $R_5$, $R_6$ and $R_7$ each represents a hydrogen atom, a halogen atom, an alkyl group which may be substituted with one or more substituents as described above for the alkyl group of $R_1$, an aryl group which may be substituted with one or more substituents as described above for the aryl group of X, an alkoxy group which may be substituted with one or more substituents as described above for the alkoxy group of $R_1$, an alkylthio group, a heterocyclic group, an amino group, an alkylamino group, a dialkylamino group, a carbonamido group, a sulfonamido group, a sulfamoyl group or a carbamoyl group; W represents a group of non-metal atoms necessary to form a 5- or 6-membered ring; $R_8$ and $R_{10}$ each represents an alkyl group, an alkoxy group, a ureido group, an alkylamino group, a dialkylamino group, a cyclic alkylamino group, an arylamino group, an acylamino group, or an N-alkylacylamino group; $R_9$ represents an alkyl group, an aralkyl group, an aryl group or a heterocyclic group, in which the aryl group may be substituted with one or more of the aryl group substituents as described hereinbefore for $R_1$; and Q represents a group of atoms necessary to form a heterocyclic ring.

4. A color photographic material comprising a support having thereon the silver halide photographic emulsion of Claim 1.

5. The color photographic material of claim 4, wherein said coupler is represented by the formula (II)

$$R_1-A_1-N=C=S \qquad (II)$$

wherein $A_1$ represents a cyan image forming coupler residue containing a phenol nucleus, a cyan image forming coupler residue containing an α-naphthol nucleus, a magenta image forming coupler residue containing a 5-pyrazolone nucleus, or a magenta image forming coupler containing a pyrazolobenzimidazole nucleus; the -N=C=S group is bonded to the coupling position of the coupler residue; $R_1$ is a hydrogen atom, an alkyl group, an alkoxy group, or an aryloxy group, wherein said alkyl, alkoxy, and aryloxy groups may be substituted with one or more of a halogen atom, a nitro group, a cyano group, a hydroxy group, a carboxy group, an aryl group, an alkoxycarbonyl group, an acyloxycarbonyl group, an amino group, an alkylamino group, a dialkylamino group, an arylamino group, an N-(alkyl)arylamino group, a carbonamido group, a sulfonamido group, an imido group, a carbamoyl group, a sulfamoyl group, an alkoxy group or an aryloxy group, or an acylamino group represented by the following formula (IV) to (VII)

| | |
|---|---|
| $-NH-CO-X$ | (IV) |
| $-NH-SO_2-X$ | (V) |
| $-NH-P(=O)(Y)(Y')$ | (VI) |
| $-NHCONH-X$ | (VII) |

or a carbamoyl group represented by the following formula (VIII) or (IX)

| | |
|---|---|
| $-CONHX$ | (VIII) |
| $-CON(Y)(Y')$ | (IX) |

wherein X represents an alkyl group or an aryl group, in which the alkyl group may be a straight chain, branched chain or cyclic alkyl group and where the alkyl group and the aryl group may be substituted with one or more of a halogen atom, a nitro group, a cyano group, a hydroxy group, a carboxy group, an amino group, an alkylamino group, a dialkylamino group, an arylamino group, an N-(alkyl)arylamino group, an aryl group, an alkoxycarbonyl group, an acyloxycarbonyl group, a carbonamido group, a sulfonamido group, an imido group, a carbamoyl group, a sulfamoyl group, an alkoxy group, or an aryloxy group; and Y and Y' each represents the above described X group or an —OX group, an —NH—X group or an $-NX_2$ group.

6. The color photographic material of claim 5, wherein said color coupler is represented by the formula (X), (XI), (XII) or (XIII)

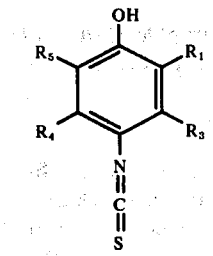
(X)

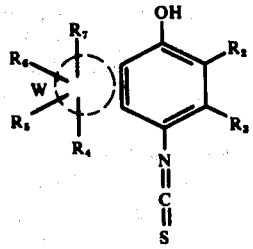
(XI)

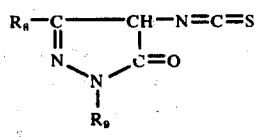
(XII)

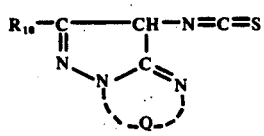
(XIII)

wherein $R_1$ is as described above; $R_2$ represents a hydrogen atom, an alkyl group, or a carbamoyl group represented by the formula (VIII) or (IX) as described above; $R_3$, $R_4$, $R_5$, $R_6$ and $R_7$ each represents a hydrogen atom, a halogen atom, an alkyl group which may be substituted with one or more substituents as described above for the alkyl group of $R_1$, an aryl group which may be substituted with one or more substituents as described above for the aryl group of X, an alkoxy group which may be substituted with one or more substituents as described above for the alkoxy group of $R_1$, an alkylthio group, a heterocyclic group, an amino group, an alkylamino group, a dialkylamino group, a carbonamido group, a sulfonamido group, a sulfamoyl group or a carbamoyl group; W represents a group of non-metal atoms necessary to form a 5- or 6-membered ring; $R_8$ and $R_{10}$ each represents an alkyl group, an alkoxy group, a ureido group, an alkylamino group, a dialkylamino group, a cyclic alkylamino group, an arylamino group, an acylamino group, or an N-alkylacylamino group; $R_9$ represents an alkyl group, an aralkyl group, an aryl group or a heterocyclic group, in which the aryl group may be substituted with one or more of the aryl group substituents as described hereinbefore for $R_1$; and Q represents a group of atoms necessary to form a heterocyclic ring.

7. A color photographic developer comprising a primary aromatic amine developing agent and containing at least one color coupler of the formula (I)

$$A-N=C=S \qquad (I)$$

wherein A represents an image forming coupler residue containing a naphthol nucleus, a phenol nucleus, a 5-pyrazolone nucleus, or a pyrazolobenzimidazole nucleus and the -N=C=S group is bonded to the coupling position of the nucleus.

8. The color photographic developer of Claim 7, wherein said coupler is represented by the formula (II)

$$R_1 - A_1 - N = C = S \qquad \text{(II)}$$

wherein $A_1$ represents a cyan image forming coupler residue containing a phenol nucleus, a cyan image forming coupler residue containing an $\alpha$-naphthol nucleus, a magenta image forming coupler residue containing a 5-pyrazolone nucleus, or a magenta image forming coupler containing a pyrazolobenzimidazole nucleus; the -N=C=S group is bonded to the coupling position of the coupler residue; $R_1$ is a hydrogen atom, an alkyl group, an alkoxy group, or an aryloxy group, wherein said alkyl, alkoxy, and aryloxy groups may be substituted with one or more of a halogen atom, a nitro group, a cyano group, a hydroxy group, a carboxy group, an aryl group, an alkoxycarbonyl group, an acyloxycarbonyl group, an amino group, an alkylamino group, a dialkylamino group, an arylamino group, an N-(alkyl)arylamino group a carbonamido group, a sulfonamido group, an imido group, a carbamoyl group, a sulfamoyl group, an alkoxy group or an aryloxy group, or an acylamino group represented by the following formula (IV) to (VII)

| | |
|---|---|
| $-NH-CO-X$ | (IV) |
| $-NH-SO_2-X$ | (V) |
| $-NH-P(=O)(Y)(Y')$ | (VI) |
| $-NHCONH-X$ | (VII) |

or a carbamoyl group represented by the following formula (VIII) or (IX)

| | |
|---|---|
| $-CONHX$ | (VIII) |
| $-CON(Y)(Y')$ | (IX) |

wherein X represents an alkyl group or an aryl group, in which the alkyl group may be a straight chain, branched chain or cyclic alkyl group and where the alkyl group and the aryl group may be substituted with one or more of a halogen atom, a nitro group, a cyano group, a hydroxy group, a carboxy group, an amino group, an alkylamino group, a dialkylamino group, an arylamino group, an N-(alkyl)arylamino group, an aryl group, an alkoxycarbonyl group, an acyloxycarbonyl group, a carbonamido group, a sulfonamido group, an imido group, a carbamoyl group, a sulfamoyl group, an alkoxy group, or an aryloxy group; and Y and Y' each represents the above described X group or an -OX group, an —NH—X group or an $-NX_2$ group.

9. The color photographic developer of claim 8, wherein said color coupler is represented by the formula (X), (XI), (XII) or (XIII)

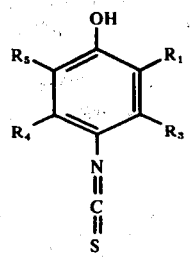
(X)

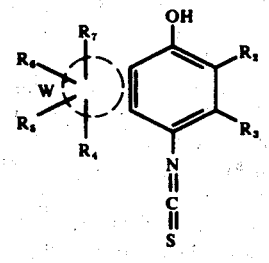
(XI)

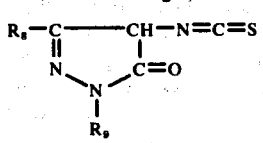
(XII)

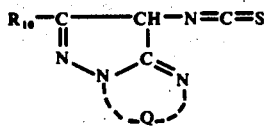
(XIII)

wherein $R_1$ is described above: $R_2$ represents a hydrogen atom, an alkyl group, or a carbamoyl group represented by the formula (VIII) or (IX) as described above; $R_3$, $R_4$, $R_5$, $R_6$, and $R_7$ each represents a hydrogen atom, a halogen atom, an alkyl group which may be substituted with one or more substituents as described above for the aryl group of $R_1$, an aryl group which may be substituted with one or more substituents as described above for the aryl group of X, an alkoxy group which may be substituted with one or more substituents as described above for the alkoxy group of $R_1$, an alkylthio group, a heterocyclic group, an amino group, an alkylamino group, a dialkylamino group, a carbonamido group, a sulfonamido group, a sulfamoyl group or a carbamoyl group; W represents a group of non-metal atoms necessary to form a 5- or 6-membered ring; $R_8$ and $R_{10}$ each represents an alkyl group, an alkoxy group, a ureido group, an alkylamino group, a dialkylamino group, a cyclic alkylamino group an arylamino group, an acylamino group, or an N-alkylacylamino group; $R_9$ represents an alkyl group, an aralkyl group, an aryl group or a heterocyclic group, in which the aryl group may be substituted with one or more of the aryl group substituents as described hereinbefore for $R_1$; and Q represents a group of atoms necessary to form a heterocyclic ring.

10. A method of forming a color photographic image comprising developing an exposed silver halide photographic material with a developer containing an aromatic primary amine developing agent in the presence of a color coupler of the formula (I)

$$A - N = C = S \qquad \text{(I)}$$

wherein A represents an image forming coupler residue containing a naphthol nucleus, a phenol nucleus, a 5-pyrazolone nucleus, or a pyrazolobenzimidazole nucleus and the -N=C=S group is bonded to the coupling position of the nucleus.

11. The method of claim 10, wherein said coupler is represented by the formula (II)

$$R_1 - A_1 - N = C = S \qquad \text{(II)}$$

wherein $A_1$ represents a cyan image forming coupler residue containing a phenol nucleus, a cyan image forming coupler residue containing an α-naphthol nucleus, a magenta image forming coupler residue containing a 5- pyrazolone nucleus, or a magenta image forming coupler containing a pyrazolobenzimidazole nucleus; the —N=C=S group is bonded to the coupling position of the coupler residue; $R_1$ is a hydrogen atom, an alkyl group, an alkoxy group, or an aryloxy group, wherein said alkyl, alkoxy, and aryloxy groups may be substituted with one or more of a halogen atom, a nitro group, a cyano group, a hydroxy group, a carboxy group, an aryl group, an alkoxycarbonyl group, an acyloxycarbonyl group, an amino group, an alkylaimino group, a dialkylamino group, an arylamino group, an N-(alkyl)arylamino group, a carbonamido group, a sulfonamido group, an imido group, a carbamoyl group, a sulfamoyl group, an alkoxy group or an aryloxy group, or an acylamino group represented by the following formula (IV) to (VII)

| | |
|---|---|
| —NH—CO—X | (IV) |
| —NH—$SO_2$—X | (V) |
| 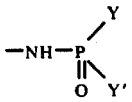 | (VI) |
| —NHCONH—X | (VII) |

or a carbamoyl group represented by the following formula (VIII) or (IX)

| | |
|---|---|
| —CONHX | (VIII) |
| 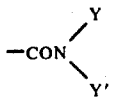 | (IX) |

wherein X represents an alkyl group or an aryl group, in which the alkyl group may be a straight chain, branched chain or cyclic alkyl group and where the alkyl group and the aryl group may be substituted with one or more of a halogen atom, a nitro group, a cyano group, a hydroxy group, a carboxy group, an amino group, an alkylamino group, a dialkylamino group, an arylamino group, an N-(alkyl)arylamino group, an aryl group, an alkoxycarbonyl group, an acyloxycabonyl group, a carbonamido group, a sulfonamido group, an imido group, a carbamoyl group, a sulfamoyl group, an alkoxy group, or an aryloxy group; and Y and Y′ each represents the above described X group or an —OX group, an —NH—X group or an —$NX_2$ group.

12. The method of claim 11, wherein said color coupler is represented by the formula (X), (XI), (XII), or (XIII)

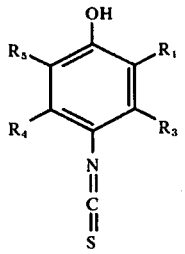
(X)

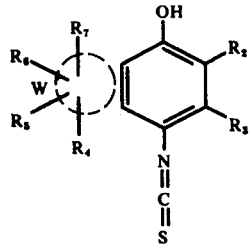
(XI)

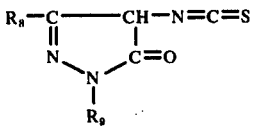
(XII)

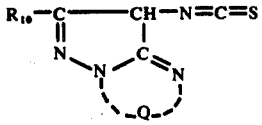
(XIII)

wherein $R_1$ is as described above; $R_2$ represents a hydrogen atom, an alkyl group, or a carbamoyl group represented by the formula (VIII) or (IX) as described above; $R_3$, $R_4$, $R_5$, $R_6$ and $R_7$ each represents a hydrogen atom, a halogen atom, an alkyl group which may be substituted with one or more substituents as described above for the alkyl group of $R_1$, an aryl group which may be substituted with one or more substituents as described above for the aryl group of X, an alkoxy group which may be substituted with one or more substituents as described above for the alkoxy group of $R_1$, an alkylthio group, a heterocyclic group, an amino group, an alkylamino group, a dialkylamino group, a carbonamido group, a sulfonamido group, a sulfamoyl group or a carbamoyl group; W represents a group of non-metal atoms necessary to form a 5- or 6-membered ring; $R_8$ and $R_{10}$ each represents an alkyl group, an alkoxy group, a ureido group, an alkylamino group, a dialkylamino group, a cyclic alkylamino group, an arylamino group, an acylamino group, or an N-alkylacylamino group; $R_9$ represents an alkyl group, an aralkyl group, an aryl group or a heterocyclic group, in which the aryl group may be substituted with one or more of the aryl group substituents as described hereinbefore for $R_1$; and Q represents a group of atoms necessary to form a heterocyclic ring.

* * * * *